United States Patent [19]

Laflaquiere et al.

[11] 4,163,304

[45] Aug. 7, 1979

[54] ROTARY CYLINDER FITTED WITH NEEDLES OR TEETH FOR THE TREATMENT OF SLIVERS OF TEXTILE FIBERS

[75] Inventors: Regis Laflaquiere; Radé Janousek; René Faessler, all of Mulhouse, France

[73] Assignee: Societe Alsacienne de Constructions Mecaniques de Mulhouse, France

[21] Appl. No.: 857,940

[22] Filed: Dec. 6, 1977

[30] Foreign Application Priority Data

Dec. 16, 1976 [FR] France ..... 76 37883

[51] Int. Cl.[2] ..... D01G 15/28

[52] U.S. Cl. ..... 19/97; 29/121.1

[58] Field of Search ..... 19/128, 126, 97, 112, 19/156.4; 15/183, 198; 29/121.1, 121.5, 121.6; 172/548, 550, 549, 554, 556

[56] References Cited

U.S. PATENT DOCUMENTS

| | | | |
|---|---|---|---|
| 41,487 | 2/1864 | Craven | 19/156.4 X |
| 483,707 | 10/1892 | Ball | 19/97 |

FOREIGN PATENT DOCUMENTS

| | | | |
|---|---|---|---|
| 783785 | 4/1935 | France | 19/128 |

*Primary Examiner*—Dorsey Newton

*Attorney, Agent, or Firm*—Holman & Stern

[57] ABSTRACT

The needles or teeth are rigidly fixed on longitudinal bars mounted on the cylinder body in such a manner as to be capable of pivotal displacement on the cylinder body about axes parallel to the axis of the cylinder. Locking means carried by the cylinder body cooperate with corresponding angular positioning means carried by each needle bar in order to lock all the bars in any predetermined common angular position, thereby setting the needles or teeth at the required angle of inclination.

7 Claims, 4 Drawing Figures

ROTARY CYLINDER FITTED WITH NEEDLES OR TEETH FOR THE TREATMENT OF SLIVERS OF TEXTILE FIBERS

This invention relates to rotary cylinders fitted with wire points, needles or teeth for the treatment of slivers of textile fibers, for example in order to attenuate the slivers employed in the spinning of separated fibers, or in drafting machines.

As a general rule, the wire points or needles of cylinders of this type are set at a certain angle of inclination with respect to a radial plane in order to ensure that the operation takes place under the best possible conditions. Thus, when said cylinders are employed in fiber-opening operations, it is desirable to ensure that the needles are set at an angle of the order of −20° to +30°, with respect to the direction of rotation and with respect to a radial plane. On the other hand, when cylinders of this type are employed in drafting operations, the needles should preferably make an angle of the order of −20° to +15° with respect to a radial plane.

As a consequence, the optimum angle of inclination of the needles depends on the nature of the slivers of fibers to be treated and is not always the same. In cylinders of known types, the needles in fact have an angle of inclination of fixed and invariable value, with the result that it is necessary to change the cylinder in order to change-over to a different type of operation which calls for a different angle of inclination of needles.

The aim of the invention is to provide a cylinder which makes it possible to overcome the above-mentioned disadvantages of known cylinders.

To this end and in accordance with the invention, the needles or teeth are rigidly fixed on longitudinal bars mounted on the cylinder body in such a manner as to be capable of pivotal displacement on said body about axes which are parallel to the axis of the cylinder whilst locking means carried by the cylinder body are adapted to co-operate with corresponding angular positioning means carried by each needle bar in order to lock all the bars on the cylinder in any desired and predetermined common angular position which sets the needles or teeth at the requisite angle of inclination.

By virtue of this particular structure, it is only necessary to produce action on the means for angular locking of the needle bars whenever it is desired to modify the angle of inclination of the needles, with the result that the same drum can be employed for performing all operations at any desired angle.

A more complete understanding of the invention will be gained from the following description and from the accompanying drawings in which a few embodiments of cylinders in accordance with the invention are shown by way of example, and in which.

Figure 1:
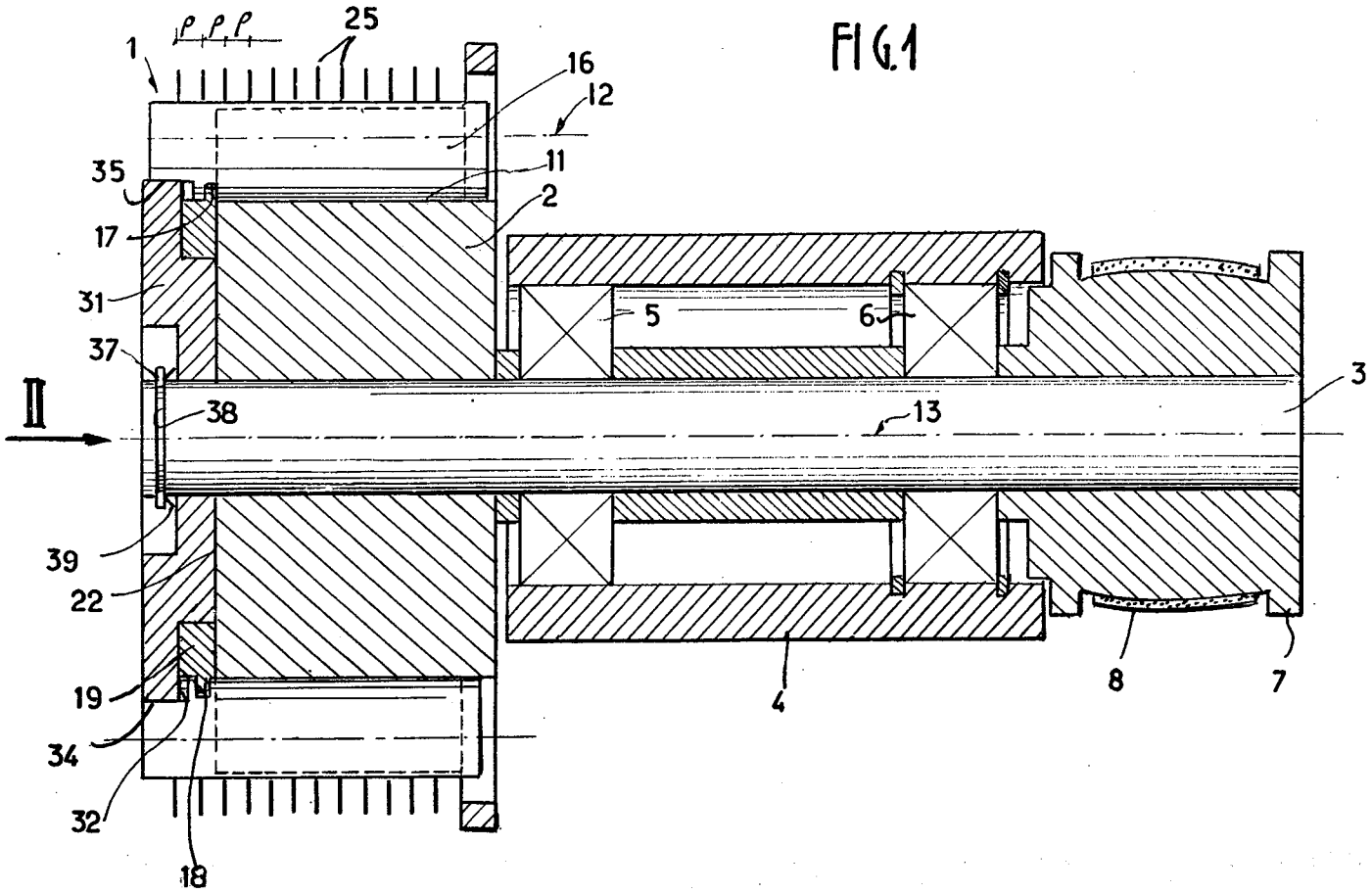
FIG. 1 is a longitudinal sectional view taken along line I-I of FIG. 2 and showing a first embodiment.
Figure 2:
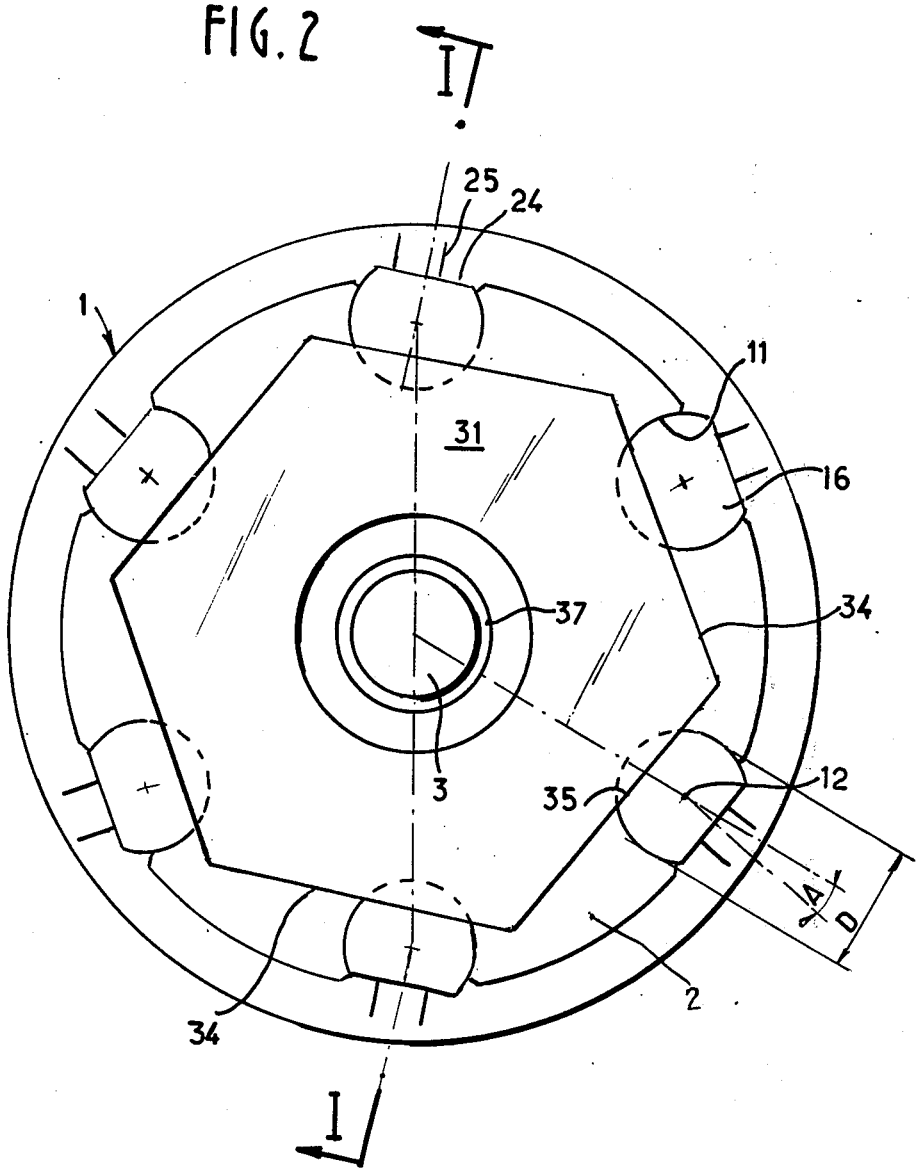
FIG. 2 is an end view looking in the direction of the arrow II of FIG. 1.

The fiber-opening cylinder shown in FIGS. 1 and 2 is generally designated by the reference numeral 1 and has a body 2 of generally cylindrical shape. Said body is keyed on a shaft 3 which is rotatably mounted in a support 4 by means of two ball-bearings 5, 6. On the shaft 3 is keyed a pulley 7 which is intended to receive a belt 8 for driving the cylinder 1 in rotation.

There are cut in the periphery of the drum body 2 cavities 11 in the shape of portions of cylinders having a diameter "D", the axes 12 of which are parallel to the axis 13 of the cylinder. The portions of cylinders 11 each extend over an arc subtending an angle of at least 180°.

A longitudinal needle bar 16 is housed within each cavity 11. Said bar also has a generally cylindrical shape and a diameter corresponding to that of the cavity in order to be capable of pivoting within this latter. Each needle bar is positioned in the axial direction by means of a transverse groove 17 which is formed in the external cylindrical surface of the bar and in which is engaged a portion of a helical rib 18. Said rib forms part of a ring 19 which is coaxial with the cylinder body 2 and applied against the corresponding end face 22 of this latter.

There is formed on each needle bar 16 a flat face 24 in which are inserted needles 25 disposed in rows parallel to the axis of the bar. In the example which is illustrated, each bar carries two rows of needles having a pitch or relative spacing "p" in each row. The pitch of the helical rib 18 is equal to the pitch "p" of the needles so as to ensure that the needles carried by any one bar are located in a transverse plane which is different from the transverse planes in which the needles of all the other bars are located.

In order to lock the needles in an angular position in which they are set at an angle of inclination "A" with respect to a radial plane, provision is made for a removable locking plate 31 which is fixed on the shaft 3 against the end face 22 of the cylinder body and provided with a recess 32 in which the ring 19 is fitted. The edge of the plate 31 has flat faces 34 applied against corresponding flat faces 35 formed on the end portions of the needle bars 16. The number of flat faces 34 of the locking plate is equal to the number of needle bars, namely six in the example shown. The position-location of the flat faces 34 on the plate and the angle of inclination of these latter correspond to the desired inclination "A" of the needles. Thus, in order to obtain a different inclination, it is only necessary to replace the plate 31 by another plate in which the flat faces are modified accordingly. To this end, the plate is removably mounted. In the example shown, said plate is retained on the shaft against the cylinder body 2 by means of a resilient snap-ring 37 fitted within an annular groove 38 of the shaft, a resilient washer 39 being interposed between the snap-ring and the plate. In order to remove the plate 31, it is therefore only necessary at the outset to remove the snap-ring 37 and the washer 38; another plate adapted to another angle of inclination of the needles can then be fitted in position and locked by replacing the washer and the snap-ring.

Figure 4:
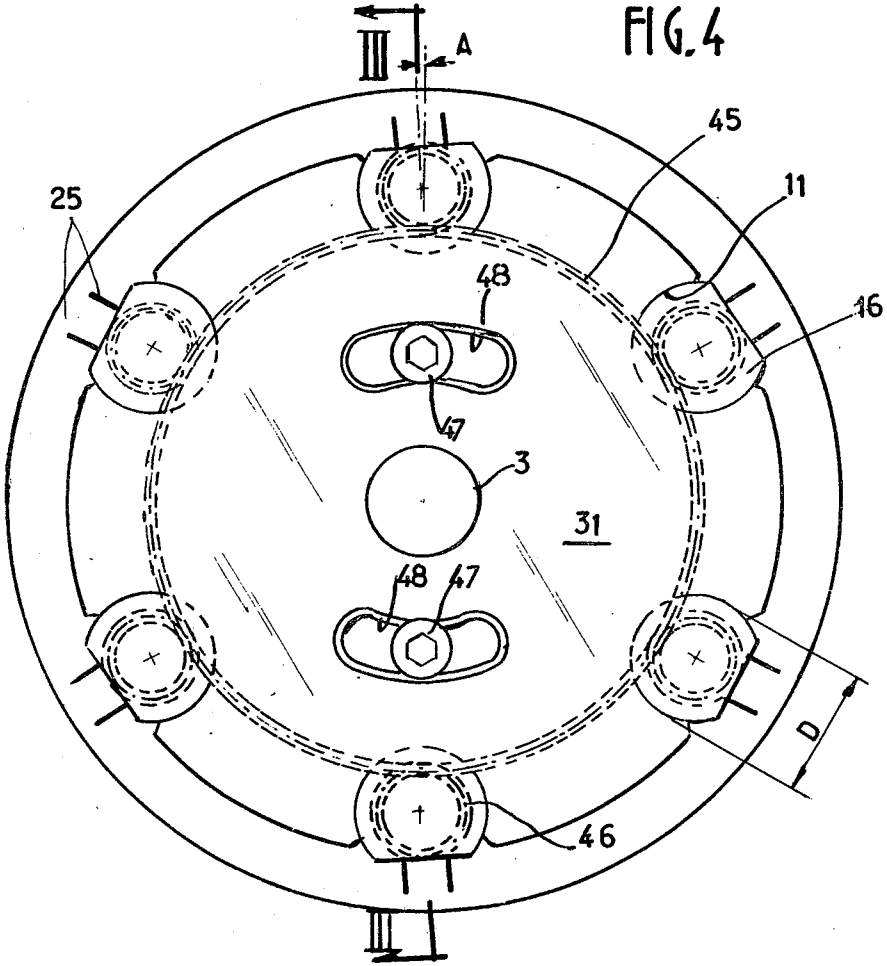
FIG. 4 is an end view looking in the direction of the arrow IV of FIG. 3.
Figure 3:
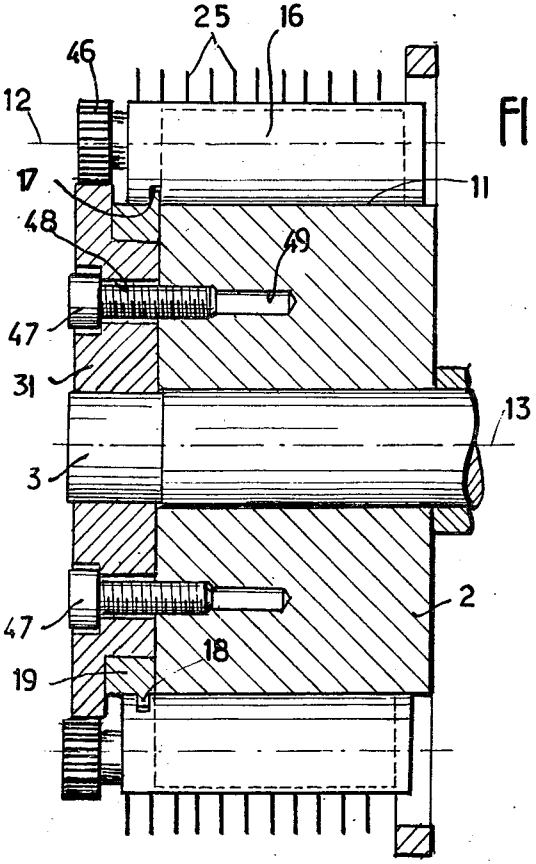
FIG. 3 is a longitudinal sectional view taken along line III-III of FIG. 4 and showing a second embodiment.

In FIGS. 3 and 4, there is shown another embodiment which differs from that of FIGS. 1 and 2 in the arrangement of the means for modifying the angular position of the needle bars. The same reference numerals have been retained in order to designate corresponding components. The plate 31 is again centered on the shaft 3 and has a circular shape. The edge of said plate is provided with a set of gear-teeth 45 disposed in coaxial relation with the cylinder and in meshing engagement with a corresponding spur pinion 46, said pinion being rigidly fixed to and coaxial with the corresponding end portion of each needle bar 16. Thus, by displacing the plate 31 in pivotal motion, all the needle bars are pivotally displaced at the same time, with the result that the angle of inclination of the needles can be modified at will. Locking of the plate 31 is effected by means of two screws 47 which pass through elongated slots 48 of the plate 31. Said slots have the shape of circular arcs which are concentric with the shaft 3. Said screws 47 are screwed into internally-threaded bores formed in the cylinder body 2.

As will be readily understood, the invention is not limited to the embodiments described in the foregoing with reference to the accompanying drawings. Depending on the applications which are contemplated, a large number of modifications can accordingly be made without thereby departing either from the scope or the spirit of the invention.

Thus it follows by way of example that the needles could be replaced by teeth having any desired profile.

We claim:

1. A cylinder for the treatment of textile fibers, especially for separating the fibers of slivers employed in open-end spinning, comprising:

a rotary cylinder body having an axis;

a plurality of longitudinal bars mounted around the periphery of said cylinder, for pivotal movement in said cylinder about axes which are parallel with the cylinder axis;

needles or teeth, rigidly fixed on a portion of the surface of each of said bars, projecting outwardly of said cylinder;

angular positioning means on each of said bars;

plate means carried by said cylinder; and mating locking means carried by said plate means and engaging said angular positioning means to lock said bars angularly in said cylinder.

2. A cylinder according to claim 8, wherein said plate means comprises at least one interchangeable removable plate & said locking means comprises the edge of said interchangeable removable plate fixed on one end face of the cylinder body and said angular positioning means comprising a corresponding flat face formed on an end portion of said needle bars.

3. A cylinder according to claim 2, wherein said at least one interchangeable removable plate comprises one single plate locking all needle bars.

4. A cylinder according to claim 8, wherein said locking means comprises a toothed ring pivotally mounted on the cylinder body in coaxial relation therewith, said angular positioning means comprises corresponding pinions rigidly fixed with respect to the needle bars and disposed in meshing engagement with said toothed ring, including further locking means serving to lock the toothed ring in any desired angular position.

5. A cylinder according to claim 1, wherein each needle bar has a generally cylindrical shape and is placed within a cavity having the shape of a corresponding portion of cylinder cut in the periphery of the cylinder body and means for axially positioning said bars in said cavities.

6. A cylinder according to claim 5, wherein all the bars fitted with needles or teeth are identical and said means for axially positioning comprises means defining a transverse groove in each of said bars and means defining a helical rib integral with a ring fixed on the cylinder body in coaxial relation therewith, said means defining a helical rib engaging with said means defining a transverse groove to axially position said bars in said cavities.

7. A cylinder according to claim 6, wherein the needles or teeth are disposed in rows and relatively spaced with a predetermined pitch p in each row and a helical rib has a pitch of the same value as said pitch of the needles.

* * * * *